United States Patent [19]

Haneda et al.

[11] Patent Number: 4,901,116

[45] Date of Patent: Feb. 13, 1990

[54] DEVELOPING APPARATUS

[75] Inventors: Satoshi Haneda; Kunihiko Yoshino, both of Hachioji, Japan

[73] Assignee: Konishiroku Photo Industry Co., Ltd., Tokyo, Japan

[21] Appl. No.: 282,828

[22] Filed: Dec. 8, 1988

Related U.S. Application Data

[63] Continuation of Ser. No. 57,164, Jun. 1, 1987, abandoned.

[30] Foreign Application Priority Data

Jun. 12, 1986 [JP] Japan ..... 61-134827

[51] Int. Cl.[4] ..... G03G 15/09; G03G 15/06

[52] U.S. Cl. ..... 355/253; 355/251; 355/299; 355/245; 430/122

[58] Field of Search ..... 355/245, 251, 253, 260, 355/299, 298, 297, 259; 118/652–658; 430/120, 122, 123

[56] References Cited

U.S. PATENT DOCUMENTS

| | | | |
|---|---|---|---|
| 2,724,674 | 11/1955 | Pritkin | 174/68.5 |
| 2,883,447 | 4/1959 | Dahl | 174/68.5 |
| 2,925,645 | 2/1960 | Bell et al. | 174/68.5 X |
| 3,889,363 | 6/1975 | Davis | 174/68.5 X |
| 4,095,866 | 6/1978 | Merill | 361/414 X |
| 4,149,486 | 4/1979 | Hardenbrook | 118/653 |
| 4,261,289 | 4/1981 | Bock | 118/652 |
| 4,591,220 | 5/1986 | Impey | 361/414 X |
| 4,598,166 | 7/1986 | Neese | 361/414 X |
| 4,606,787 | 8/1986 | Pelligrino | 156/632 |
| 4,610,531 | 9/1986 | Hayashi et al. | 430/122 X |
| 4,689,110 | 8/1987 | Leibowitz | 361/414 X |
| 4,766,458 | 8/1988 | Oka et al. | 118/657 X |
| 4,821,075 | 4/1989 | Saito et al. | 118/657 X |

FOREIGN PATENT DOCUMENTS

| | | | |
|---|---|---|---|
| 0098774 | 7/1980 | Japan | 355/3 DD |
| 0100455 | 6/1982 | Japan | 355/3 DD |
| 0111564 | 7/1982 | Japan | 355/14 D |
| 0009675 | 1/1986 | Japan | 355/3 DD |
| 0043762 | 3/1986 | Japan | 355/3 DD |

*Primary Examiner*—A. C. Prescott
*Assistant Examiner*—Matthew S. Smith
*Attorney, Agent, or Firm*—Jordan B. Bierman

[57] ABSTRACT

The invention provides an electrostatic copier having a smoothing member at an upstream side in the developer conveying direction in the vicinity of a developing area between a developer conveyer and an image-forming member in order to smooth a developer layer on the conveyor prior to transfer of the image forming member. Further, one surface of the smoothing member is so arranged as to come in contact with the image-forming member and another surface smoothes the developer layer. The developer conveyer has a magnet member therein and the magnet member is positioned to face the smoothing portion of the smoothing member.

22 Claims, 2 Drawing Sheets

DEVELOPING APPARATUS

This application is a continuation of application Ser. No. 057,164, filed June 1, 1987 now abandoned.

This application claims the priority of Japanese Application No. 134,827/86, filed June 12, 1986.

BACKGROUND OF THE INVENTION

This invention relates to developing apparatus for recording equipment wherein toner particles adhere to an electrostatic latent image or a magnetic latent image formed on the surface of an image-forming member by electrophotography, electrostatic recording, electrostatic printing, or magnetic recording. The device is useful for one or two component developers, both the contact and non-contact developing methods.

Conventionally, among the above contact type or non-contact type developing apparatus, such as the developing apparatus that so forms the developer layer on the developer carrier as not to heavily rub with the surface of the image forming member and causes the toner to adhere onto the latent image of the image forming member under the condition of the oscillating electric field, the developing apparatus using one-component developer has been known in the Japanese Patent Publication Open to Public Inspections, No. 18656~18659/1980 (hereinafter referred to as Japanese Patent O.P.I. Publication); the developing apparatus using two-component developer has been known in the Japanese Patent O.P.I. Publications, No. 144452/1981, No. 139761/1982, No. 147652/1982, No. 48065/1983, No. 181362/1984, and No. 222847/1984. In these developing apparatuses described above, unlike the developing apparatuses wherein the surface of the image-forming member comes into contact with and is heavily rubbed by the developer layer, since the developing is carried out under the oscillating electric field, sweeping marks on the toner image are not generated, and fogging is not apt to occur. Moreover, in the case where the developing is carried out under the non-contact condition, even if development is doubly conducted on the surface of the image-forming member on which a toner image is already formed, the previously formed toner image is not damaged, thus providing excellent recording equipment wherein a color image is formed by combining a plurality of toner images on the image-forming member. Furthermore, the developing apparatus using two-component developer, compared with that using one-component developer, has to keep a constant toner particle ratio of the developer and also has a problem that the carrier particles gradually deteriorate with time; however, frictional electrification control of the toner particles becomes easy, and no toner particle agglomeration is apt to occur, thus facilitating formation of a uniform developer layer on the surface of the developer carrier, and the magnetic particles do not have to be added in the toner. Consequently, the color of the toner image other than black and brown become clear, thus providing a excellent equipment for recording color images.

Even in the developing apparatus described above, nonuniformity or fogging of development may occur. To prevent these problems from occurring, it is effective to form a uniform and thin developer layer, and, by doing so, to reduce the clearance for development between the developer carrier and image-forming member and to increase the electric field strength.

In this respect, in the conventional developing apparatus that regulates the thickness of the developer layer by means of only a layer-thickness-regulating member forming a passage gate for the developer layer; due to the fluctuation of the magnetic field strength which makes the surface of the developer carrier adsorb the developer, the disadvantage that the agglomerated developer or waste is apt to clog the narrow clearance-regulating portion between the developer carrier and the layer-thickness-regulating member, and so on. The thinner the layer is regulated, the larger becomes the nonuniformity of the layer thickness; thus forming a uniform and thin developer is very difficult. This problem becomes more apparent because of some causes such as the tendency of the developer susceptible to agglomeration, especially when using toner particles and carrier particles, which are finer than the conventional carrier particles with an average diameter ranging from several tens μm to several hundreds μm or the conventional toner particles with an average diameter larger than several tens μm, as the developer in order to obtain a high-quality image reproduced with variable density or delicate lines and points; thus, causing the problem that the nonuniformity in the regulation of the layer thickness is apt to result in development nonuniformity.

In a developing apparatus wherein the developer layer comes in contact with and rubs the surface of an image-forming member, the following two methods are known to be adopted according to the Japanese Utility Model Publication Open to Public Inspection No. 107336/1979 and No. 9797/1982 (hereinafter referred to as Japanese Model Utility O.P.I. Publication): The one method is that a magnetic piece is mounted on the layer-thickness-regulating made of non-magnetic material in order to prevent problems such as fogging caused by fly toner particles which are generated when the depressed developer layer expands after passing the layer-thickness-regulating member; the other method is that a blade made of non-magnetic material is mounted which comes in contact with the developer layer that has just passed the layer-thickness-regulating member and provides the toner particles with static electrification in order to prevent the toner particles of the developer layer which has passed the layer-thickness-regulating member from flying because of static-electrification shortage, and in order to prevent the toner particles from causing fogging.

The inventors have studied and improved the above-mentioned methods, they have obtained the result that a smoothing member which makes the layer thickness uniform by touching the developer layer should be positioned near the development area instead of just after the layer-thickness-regulating member in order to obtain a uniform and thin developer layer. At the same time, in the developing apparatus wherein the developer layer does not come in contact with and rub the surface of the image-forming member, it has proved that if the clearance for development is to be decreased, the developer layer is apt to come in contact with and rub the surface of the image-forming member, and that setting a narrow clearance for development which does not come in contact with and rub the surface of the image-forming member is difficult.

SUMMARY OF THE INVENTION

The present invention is based on the above-described concept, aiming to provide a developing apparatus wherein a uniform and thin developer layer can be formed on the developer carrier or a developer conveying member. Additionally, the present invention facilitates setting a narrow clearance for development whereby the developer layer and image-forming member do not come in contact with each other.

The present invention is characterized by the smoothing member, contacting the surface of the image-forming member at the upstream portion near the developing area, which is installed in a developing apparatus wherein a developer layer is formed on the surface of the developer carrier, and latent image is developed by making toner particles from the abovementioned developer layer adhere to the surface of the imageforming member, thus the purpose of the invention described above is achieved.

The present invention can be preferably applied to the developing apparatus disclosed in the Japanese Patent O.P.I. Publications, Nos. 18656~18659/1980, Nos. 139761~139762/ 1982, No. 480652/1983 and No. 222847/1984. The present invention, of course, can be also applied to the conventional contact type developing apparatus which cause the developer to contact with the image forming surface.

DETAILED DESCRIPTION OF THE INVENTION

As one example of the concrete constitution according to the invention, non-contact type developing apparatus will be explained hereinafter wherein the developer layer is so formed on the developer carrier not to contact with the image forming member and the toner is adhered the latent image under the oscillating electric field.

Figure 1:
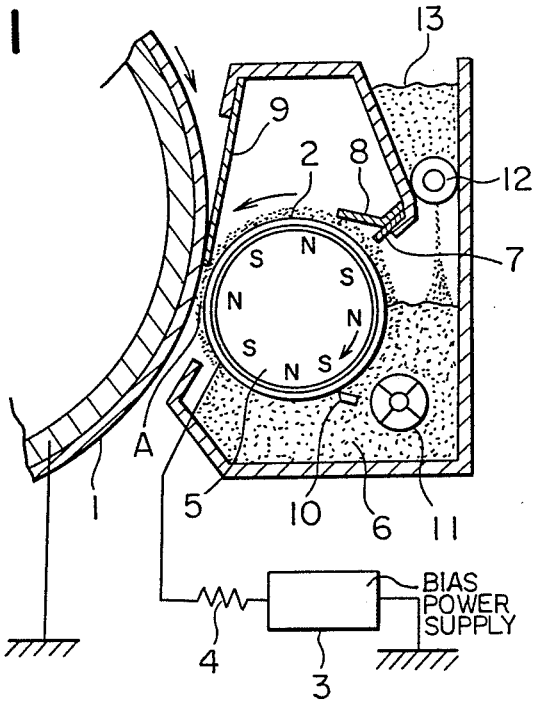
FIG. 1, FIG. 2 and FIG. 3 are drawings showing the embodiments of the present invention.
Figure 2:
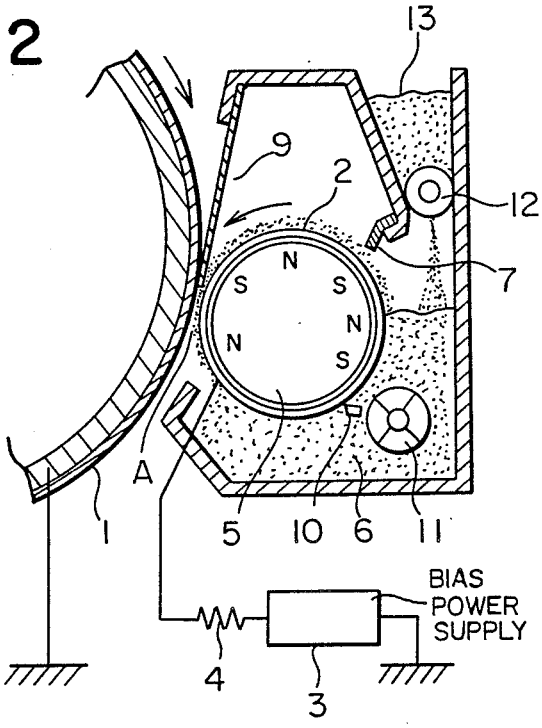
Figure 3:
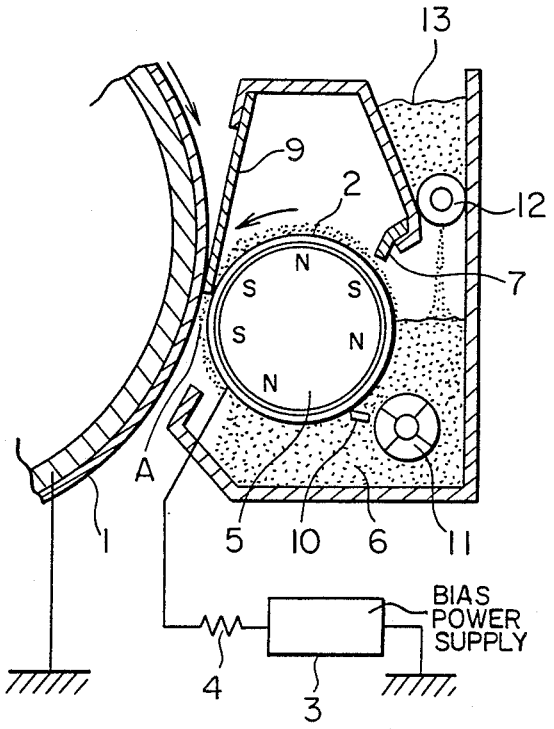

Referring now to the detailed description of the invention according to the drawings; FIG. 1, FIG. 2 and FIG. 3 are schematic drawings showing examples of the developing apparatus of the present invention. In the drawings, 1 represents an imageforming member being cylindrical, having an image-forming layer on its surface comprising dielectric material and photosensitive material such as Se, forming an electrostatic latent image on the image-forming layer by means of static electrification and exposure device which are not shown in the drawing, and rotating in the direction of an arrow shown. Numeral 2 represents a developer carrier or a developer conveying member usually made of electrically-conductive non-magnetic material such as aluminum or stainless-steel. It has a smooth surface or a convexo concave surface which is approximately 10 to 500 μm. The surface of the developer carrier 2 is preferably applied with insulation-treatment or semi-insulation-treatment by means of resin or oxide film; by doing so, even if bias voltage is applied to developer carrier 2 in order to generate oscillating electric field in developing area A, insulation breakdown such as flash-to-ground phenomenon is not apt to occur, thus facilitating migration control of the toner particles by sufficiently applying bias voltage to developer carrier 2.

Numeral 3 represents a bias power supply which applies bias voltage through protective resistor 4 to developer carrier 2 and generates an oscillating electric field between developer carrier 2 and image-forming member 1 whose substrate portion is grounded. Numeral 5 represents magnet body installed in developer carrier 2. The surface of the magnet body 5 has a plurality of N and S magnetic poles in the circumferential direction; normally, the N and S magnetic poles are magnetized to provide the surface of developer carrier 2 with 500 to 1500 gauss of magnetic flux density.

In the developing apparatus shown in FIG. 1, developer carrier 2 rotates in the arrowed direction so that its moving direction becomes identical to that of image-forming member 1 in developing area A; magnetic body 5 rotates in the opposite direction shown by an arrow, thus the developer absorbed by the surface of developer carrier 2 from developer reservoir 6 by means of the magnetic intensity of magnet body 5 is shifted to the same rotation direction of developer carrier 2 by the rotation of developer carrier 2 and magnetic body 5; during the shifting motion the layer thickness is regulated by layer-thickness regulating member 7 consisting of non-magnetic or magnetic material; furthermore, the layer thickness is made uniform by means of auxiliary smoothing member 8 made of flexible or rigid material, thus a uniform developer layer is formed. In the developing apparatuses shown in FIG. 2 and FIG. 3, unlike the developing apparatus shown in FIG. 1, magnet body 5 is fixed and the developer is carried only by means of rotating developer carrier 2 in the arrowed direction; moreover, auxiliary smoothing 8 is omitted. In the developing apparatus shown in FIG. 2, different magnetic poles of magnet body 5 are arranged at both upper and lower portions of developing area A; thus forming an approximately horizontal magnetic field wherein the direction of magnetic force line in developing area A is approximately parallel to the surface of image-forming member 1 and developer carrier 2. On the other hand, in the developing apparatus shown in FIG. 3, the same magnetic poles area arranged at both upper and lower portions of developing area A; thus, forming a repulsive magnetic field in developing area A.

In the developing apparatus wherein magnetic body 5 rotates, the capacity of carrying developer is enhanced and the developer smoothly passes layer-thickness-regulating member 7 and auxiliary smoothing member 8; furthermore, even if the developer layer thickness fluctuates, the rotating magnet body 5 can compensate such fluctuation. While, in the developing apparatus wherein magnet body 5 is fixed, as shown in FIG. 2 and FIG. 3, magnetic poles are arranged facing layer-thickness-regulating member 7, and magnetic material is used for layer-thickness-regulating member 7; thus the layer thickness is regulated smoothly, and the clearance for development can be easily narrowed because the apparent developer layer thickness at the developing area A becomes stabilized. In the developing apparatus wherein magnet body 5 rotates, developer carrier 2 may be fixed or rotated in the opposite direction to the direction shown in FIG. 1 without changing the carrying direction of the developer. When auxiliary smoothing member 8 is installed, much more even developer layer can be obtained compared with the developing apparatus wherein only layer-thickness-regulating member 7 is used; on the other hand, however, the developer is apt to be congested, and the uniformity of the layer thickness obtained only by installing auxiliary layer-thickness-regulating member 8 right behind layer-thickness-regulating member 7 is not uniform enough to meet the purpose of the present invention. In the developing apparatus wherein a horizontal magnetic field in developing area A is formed by means of fixed magnet body 5, the thickness of the developer layer in developing area A becomes thinner than that obtained in the developing apparatus wherein repulsive a magnetic field is formed or magnetic body 5 rotates; thus, much narrower clearance for development becomes possible. On the other hand, in the developing apparatus wherein a repulsive magnetic field in developing area A is formed by fixed magnet body 5, development is made by fully utilizing the advantage of powder-cloud development method; thus allowing high-density image development.

Describing the developing apparatus more in detail wherein a horizontal or repulsive magnetic field is generated by fixed magnet body 5 in developing area A, the magnetic poles to be arranged at both upper and lower portions of developing area A are preferably respectively positioned 5 to 90 degrees apart from the center line connected between both centers of image-forming member 1 and developer carrier 2; furthermore, the angle of circumference between the center line and the downstream-side (lower side) magnetic pole should be preferably smaller than the angle of circumference between the center line and the upstream-side (upper side) magnetic pole. Moreover, the magnetization of the downstream-side magnetic pole should be preferably intensified so that a strong magnetic field is generated at the downstream-side portion of developing area A. Also, the diameter of developer carrier 2 should be preferably small so that the top of the magnetic brush of the developer layer do not come in contact with the surface of image-forming member 1, i.e., from 40 to 10 mm in diameter. Likewise, the diameter of drum-shaped image-forming member 1 should be preferably small, i.e., from 300 to 10 mm in diameter. When the configuration of image-forming member 1 is loop like a belt, a belt-drive roller should be installed in the position for developing area A, so that the above-mentioned conditions are satisfied.

In the developing apparatus of the present invention, adding to the above-described developing system, in order to smooth the developer layer on developer carrier 2, smoothing member 9 is installed in contact with the surface of imageforming member 1 at the upstream-side portion near developing area A. Numeral 10 represents cleaning blade which returns the residual developer layer, after passing developing area A, formed on developer carrier 2 to developer reservoir 6; numeral 11 represents agitating roller which agitates and homogenizes the developer in developer reservoir 6, as well as frictionally electrifies the toner particles; numeral 12 represents a toner supply roller which supplies developer reservoir 6 with toner particles from toner hopper 13.

As for the material for smoothing member 9, material having following characteristics is preferably used, which does not blemish the surface of image forming member 1 or developer carrier 2, has an excellent wear resistance, generates no breakdown of development bias even if high-pressure development bias is applied to developer carrier 2, and consists of 0.02 to 2 mm thick insulating elastic material; for example, materials such as urethane rubber or thin resin sheet may be prefer. The material for smoothing member 9, however, is not limited to such elastic material, but rigid material will do as well. By installing such smoothing member 9, the developer layer is smoothed just before developing area A, eliminating stripe-shaped nonuniformity which is apt to be generated by the problems such as clogging at the regulating portion of layer-thickness-regulating member 7, thus uniform thin developer layer is fed to developing area A. Smoothing member 9 should be preferably installed in such a manner that its tip reaches the upstream-side portion near the position where developer carrier 2 and image-forming member come nearest to each other. When the developing apparatus is positioned so that smoothing member 9 slightly touches the surface of image-forming member 1, and furthermore touches the surface of developer carrier 2, then the clearance for development is set sufficiently narrow, still the development layer does not come in contact with and rub the surface of image-forming member. By doing this, oscillation electric field acts strongly upon developing area A, and the toner particles efficiently migrates from thin and uniform developer layer to the latent image of image-forming member 1, thus allowing clear toner development free from nonuniformity and foggings.

Unlike layer-thickness-regulating member 7, smoothing member 9 does not form a passage gate for the developer; and unlike blade shown in Japanese Utility Model O.P.I. Publication No. 9797/1983, smoothing member 9 does not frictionally electrify the toner particles; therefore, the developer does not collect at the position of smoothing member 9, and clogging is not generated. Accordingly, as mentioned before, smoothing member may be formed by rigid material. If the smoothing member 9 is formed by the rigid material, care must be taken so that tip should not touch and blemish the surface of imageforming member 1 and developer carrier 2. When the rigid material is used for the smoothing member 9, the developer layer can be made much more uniform, because the rigid material is free from elastic displacement. However, when the developer layer thickness regulated by layer-thickness-regulating member 7 fluctuates to a great extent, or the developer layer contains the agglomerated toner particles, it is safer to use elastic material from the viewpoint of preventing the retention of developer. When the elastic material is used for smoothing member 9, the elastic displacement occurs easily; therefore, the setting conditions are mitigated. In addition, in the developing apparatus of the present invention, the development is done by applying high oscillation electric field to developing area A; therefore, the insulating material should be used for smoothing member 9, especially when the surface of developer carrier 2 has no insulation properties so that smoothing member 9 does not cause the electric field breakdown. As for the insulating materials for smoothing member 9, rubber plates (e.g., urethane rubber plate) with rubber hardness 20 to 100, thickness 100 to 1000 μm, or polyethylene terephthalate plates with thickness 50 to 200 μm, are preferably used. The phosphor bronze plate or stainless steel plate with thickness 20 to 300 μm coated with insulating material is also used on the condition of those materials being electrically floating. Smoothing member 9 does not serve to frictionally electrify the toner particles; however, the smoothing member chafe the toner particles, therefore, at least one of smoothing member surface facing developer carrier 2 may be preferably made of the material which does not give the reversed-polarity friction electrification to the toner particles. The smoothing member 9 may be made of magnetic material or nonmagnetic material; however, the nonmagnetic material is preferable, because the nonmagnetic material does not interrupt the passage of the developer.

To generate an oscillation electric field in developing area A, besides, as shown in the drawing, applying development bias to developer carrier 2; a migration-control electrode like wire electrode or net electrode which does not interrupt the migration of toner particles may be installed in developing area A, and the oscillation voltage may be applied to the electrode. In this case, smoothing member 9 should be installed in the upstream-side portion of the migration-control electrode.

Smoothing member 9 should be preferably installed by means of, for example, screws so that the insertion degree of smoothing member 9 into developing area A can be adjusted; however, smoothing member 9 may be also fixed by means of, for example, adhesives or rivets. In the developing apparatus wherein magnet body 5 is fixed, smoothing member 9 should be preferably installed in such a manner that smoothing member 9 comes in contact with image-forming member 1 at the position near the magnetic pole in the upstream-side portion of developing area A. Furthermore, the magnetic field intensity at that position should be preferably more than 300 gauss, especially the range from 500 to 1500 gauss is desirable; since the developer layer carrying power of developer carrier 2 becomes strong at the position where there is provided such strong magnetic field, thereby preventing smoothing member 9 from collecting the developer more than necessary by interrupting the passage of the developer layer.

As described above, according to the developing apparatus of the present invention wherein smoothing member 9 is installed, a thin and uniform developer layer to be fed to developing area A can be formed, and a clear toner image free from nonuniformity and fogging can be developed by means of the effect of a strong oscillation electric field generated in a narrow clearance for development wherein the development layer does not come in contact with and rub the surface of image-forming member 1. Describing the developing conditions for the abovementioned development, the clearance between the surfaces of image-forming member 1 and developer carrier 2 should be preferably within the range from several tens of μm to 2,000 μm, and a thin and uniform development layer should be preferably formed as close to as possible, still without coming into contact with the surface of image-forming member 1 by means of layer-regulating member 7 and smoothing member 9. If the clearance between image-forming member 1 and developer carrier is set excessively narrow, the developer layer should be formed much more thinner than the clearance; therefore, the relative uniformity is apt to be deteriorated as well as feeding the toner particles to developing area A tends to be shortend, thus performing a clear development becomes difficult. Moreover, if the clearance between the surfaces of image-forming member 1 and developer carrier 2 exceeds 2,000 μm greatly, migration control of the toner particles by means of oscillation electric field cannot be carried out effectively, thus a sufficient development density cannot be obtained. The clearance between the surfaces of image-forming member 1 and developer carrier 2 is set within the range from several tens of μm to 2,000 μm, preferably from 500 to 1,500 μm, the developer layer with appropriate 100 to 1,000 μm thickness can be uniformly formed on the surface of developer carrier 2, thus allowing effective migration control of the toner particles by means of oscillation electric field.

The oscillation electric field, which facilitates the toner particles to separate from the developer layer, generated between developer carrier 2 and image-forming member 1, should be preferably obtained in the following manner: Bias power supply 3 applies the AC component effective value 200 to 5,000 V, and frequency 100 Hz to 10 kHz, preferably 300 to 400 V and 1 to 5 kHz of bias voltage to developer carrier 2, whereby the electric-field-intensity having effective value 300 to 5,000 V/mm is obtained. Of course, the appropriate DC voltage having the same polarity as that of the non-image-portion potential of image-forming member 1 is applied to developer carrier 2 as bias voltage superimposed onto the AC component by bias power supply 3 in order to prevent generation of foggings.

Also in the case where the control electrode is installed in developing area A and then the bias voltage is applied to the control electrode, AC component, as well as DC component can be applied as bias voltage. Furthermore, DC voltage, as well as AC voltage may be applied; in this case, the AC component having different frequency from the AC component applied to the control electrode may be applied to developer carrier 2.

The AC component waveform of the bias voltage applied to developer carrier 2 or control electrode is not limited to the sine wave; also the triangular wave or rectangular wave will do. The present invention can be applied not only to the normal development bus also to the reversal development by appropriately setting the voltage and polarity of bias voltage DC component. In the case of the reversal development, the DC component of the bias voltage is set to the level approximately identical to the acceptance electric potential in the non-image background of the image-forming member.

In the developing apparatus according to the present invention, one-component developer is used; however, two-component developer as well as using the two-component developer, if the toner particles contain magnetic particles, the developing apparatus according to the present invention may be used for developing the magnetic latent image. As for the two-component developer, of course the mixed developer comprising the conventional magnetic carrier particles with average diameter ranging from several tens of μm to several hundreds of μm and the nonmagnetic toner particles with average diameter of several tens of μm is used. However, in order to obtain a high quality image which reproduces delicate lines, points and variable density, a developer comprising the toner particles with weight-average particle diameter ranging from 1 to 20 μm and magnetic carrier particles with weight-average diameter ranging from 5 to 50 μm should be preferably used. Moreover, the developer should be preferably comprised of the insulated particles such as the resin particles which contain the magnetic particles or the magnetic carrier particles coated with resin film, permitting the developer carrier 2 to be applied with high bias voltage. The insulating performance of the carrier particles should have preferably the resistivity over $10^8\Omega$cm, especially more than $10^{13}\Omega$cm. The resistivity in this case is the value obtained by reading the current value which is generated when the particles are tapped in a container with a cross-sectional area 0.50 $cm^2$, and the load 1 $Kg/cm^2$ is applied onto the packed particles, then the voltage is applied so that an electrical field 1000V/cm is generated between the load and bottom face electrode. If this resistivity is low, when bias voltage is applied to the developer carrier 2, electrical charge is given to the carrier particles, resulting in that the carrier particles are apt to adhere to the image carrier surface, or the breakdown of the bias voltage is apt to be generated.

According to the developing apparatus of the present invention, as described previously, the developer layer can be formed smoothly on developer carrier 2, and a sufficiently narrow clearance for development can be easily set, still the developer layer does not come into contact with and rub the surface of the image-forming member, and the migration control of the toner particles by means of the oscillation electric field is performed efficiently; therefore, even if fine toner particle or fine carrier particles are used, the toner particles can easily migrate from the developer layer to the latent image of image-forming member 1 under the non-contact developing condition, thereby allowing reproduction of a high quality image. The weight-average particle diameter of the toner particles or carrier particles is measured by the Coalter counter (manufactured by Coalter Co., Ltd.) or Omnicon Alpha (manufactured by Bosh & Rohm Co., Ltd.).

Next, the embodiments of the present invention are described.

EMBODIMENT 1

In the developing apparatus shown in FIG. 2, developer carrier 2 is cylindrical having an external diameter 30 mm; its stainless steel surface is sandblasted to form convexoconcave of approximately 20 μm, and the developer carrier 2 rotates at 65 rpm in the direction shown by the arrow. The magnetic poles N and S of magnet body 5 positioned at both upper and lower portions of developing area A give the magnetic flux density of 900 gauss to the surface of developer carrier 2, and N and S magnetic poles other than above-described poles give the magnetic flux density of 500 gauss to the surface of developer carrier 2. Layer-thickness-regulating blade 7 is made of nonmagnetic stainless steel, to which the same voltage of developer carrier 2 is applied, and smoothing member 9 is made of 200 μm thick urethane rubber plate (rubber hardness 30 degree). The developer used in this developing apparatus comprises insulated carrier particles with specific resistance of approximately 1x $10^{14}\Omega$cm containing magnetic powder mixed with resin being weight-average particle diameter of 30 μm, and insulated non-magnetic toner particles being weight-average particle diameter 7 μm. The clearance between layer-regulating blade 7 and developer carrier 2 is made to have 300 μm width; and the developer layer is formed as thick as 700 μm at the highest portion, while 300 μm at the lowest portion. The developer layer is smoothed by smoothing member 9 which is close to the surface of developer carrier 2 and touches the surface of image-forming member 1 as a result, the developer is not collected at the position of smoothing member 9, and the uniformity of the developer layer thickness is greatly improved compared with the developing apparatus without smoothing member 9. Development using this developer layer is done under the conditions wherein the clearance between the surfaces of developer carrier 2 and image-forming member 1 which has the image-forming layer comprising organic photoconductor OPC and rotates at 120 mm/sec. in circumferential speed to the arrowed direction, is set to 500 μm. The latent image formed at image-forming member 1 is an electrostatic latent image with image electric potential of −500 V against the non-image background electric potential of −50 V; when making development, bias power supply 3 applies AC voltage of 2 kHz, 1.5 kV, and DC voltage of −150 V to developer carrier 2. Also, the same voltage is applied to layer-thickness-regulating member 7 so that the oscillation electric field of developing area A does not suffer from breakdown.

The toner image developed according to the above-described conditions is corona-discharge-transfered to an ordinary paper by means of a transfer system not shown in the drawing, and is fixed by means of a heated-roller fixing system with the surface temperature of 140° C. The recorded image obtained by above-mentioned procedures is free from nonuniformity and foggings, and the density is high enough to provide a clear image. In the same manner, 50,000 sheets of recorded paper were obtained; during the operation, although developer cloggings occurred at layer-thickness-regulating member 7, clear recorded papers were obtained from the beginning to the final sheet, because the developer layer was kept uniform by smoothing member 9. On the other hand, in the case wherein smoothing member 9 was not installed, the clogging generated at layer-thickness-regulating means 7 gradually became to cause the developer layer to generate nonuniformity, resulting in the deteriorated recorded papers; thus, the allowable recording capacity may be approximately 10,000 sheets of recorded papers; moreover, stripes and dry spots were found in the recorded image.

Incidentally the allowable range of position setting of developer carrier 2 in response to image-forming member 1 can be enlarged by means of smoothing member 9.

EMBODIMENT 2

In the developing apparatus shown in FIG. 3, the magnetic poels S and S positioned both upper and lower portions of developing area A of magnetic body 5 give the magnetic flux density of 1,000 gauss (700 gauss magnetic flux density to the midpoint between the magnetic poles S and S) to the surface of developer carrier 2; while, the magnetic poles N and S other than those described above give magnetic flux density of 500 gauss; thus, the conditions are same as those of embodiment 1, except that smoothing member 9 employs a resin plate made of polyethylene terephthalate with thickness of 50 μm. Under the same conditions of embodiment 1, 50,000 sheets of recording paper were made, resulting in obtaining the same performance as that of embodiment 1.

Embodiments 1 and 2 indicate examples in which the invention is applied to the non-contact type developing apparatus, however, the invention should be not limited to these examples and the invention can be applied to the contact-type developing apparatus in the same manner with the aforementioned.

Namely, as already described, in the contact type developing apparatus, there have been several following developing problems. The fluctuation in the magnetic field and the partial blocking in the layer thickness regulating area may cause uneven developing layer, thereby causing ununiformity in the developing. The scattering toner may cause fogging phenomenon. The retention of the developer around the upper side of the developing area may cause the developer layer thickness to be too thick, and then also cause the contact width of developer to the image forming member in the circumferential direction to be too long. In the result that the rubbing force of developer becomes too strong and then brush marks may easily take place on the toner image.

As a countermeasure against the above problems, by providing the smoothing member according to the invention, an even developer layer may be formed on the developing area, thereby overcoming the above problems.

According to the development apparatus of the present invention, a uniform and thin development layer can be fed stably to the development area, thereby obtaining highly stable toner image. Moreover, in non-contact type developing method, the clearance for development can be easily set sufficiently narrow, still the development layer does not come into contact with the surface of the image-forming member, and the migration control of the toner particles from the developer layer by means of the oscillation electric field can be efficiently conducted; therefore, uniform and clear toner development can be performed, and the developer comprising fine carrier particles and fine toner particles can be effectively used without any problems, thus, allowing the effect wherein the high-resolution and high-quality image is reproduced.

We claim:

1. A developer apparatus comprising an image-forming means having a moving surface on which a latent image is developed by a developer containing toner particles, said apparatus further comprising, a developer-conveying means for conveying a magnetic developer containing toner particles, said developer-conveying means having a magnet therein whereby said developer forms a developer layer on said developer-conveying means, said developer layer having a predetermined width transverse to a developer-conveying direction, said developer-conveying means facing the moving surface of said image-forming means whereby a developing area is formed on said moving surface, at a position opposite said developer-conveying means, and a smoothing member comprising a plate-shaped member having a width substantially equal to the predetermined width of said developer layer, said smoothing member being positioned upstream of a moving direction of the moving surface of said image-forming means near said developing area whereby one side of said plate-shaped member contacts the surface of said developer layer and another side of said smoothing member contacts the moving surface of said image-forming means bearing said latent image being developed.

2. The developing apparatus of claim 1 wherein the developing area is provided an oscillating electric field.

3. The developing apparatus of claim 2, wherein said smoothing member is an elastic member.

4. The developing apparatus of claim 3 wherein said developer-conveying member has a magnet member therein for attracting said developer.

5. The developing apparatus of claim 2, wherein said smoothing member is an rigid member.

6. The developing apparatus of claim 5 wherein said developer-conveying member has a magnet member therein for attracting the developer.

7. The developing apparatus of claim 2, wherein said developer conveying member has a magnet member therein for attracting the developer, and wherein a smoothing portion of said smoothing member faces a disposing position of said magnet member.

8. The developing apparatus of claim 1, wherein said smoothing member smooths the developer layer so that it does not come in contact with said image forming member, and wherein the developing area is provided an oscillating electric field.

9. The developing apparatus of claim 8, wherein said smoothing member is an elastic member.

10. The developing apparatus of claim 9, wherein said developer conveying member has a magnet member therein for attracting the developer, and wherein a smoothing portion of said smoothing member faces a disposing position of said magnet member.

11. The developing apparatus of claim 8, wherein said smoothing member is an rigid member.

12. The developing apparatus of claim 11 wherein said developer-conveying member has a magnet member therein for attracting the developer.

13. The developing apparatus of claim 8, wherein said developer conveying member has a magnet member therein for attracting the developer, and wherein a smoothing portion of said smoothing member faces a disposing position of said magnet member.

14. The developing apparatus of claim 1, wherein said smoothing member is an elastic member.

15. The developing apparatus of claim 14, wherein said developer conveying member has a magnet member therein for attracting the developer, and wherein a smoothing portion of said smoothing member faces a disposing position of said magnet member.

16. The developing apparatus of claim 1, wherein said smoothing member is an rigid member.

17. The developing apparatus of claim 16, wherein said developer conveying member has a magnet member therein for attracting the developer, and wherein a smoothing portion of said smoothing member faces a disposing position of said magnet member.

18. The developing apparatus of claim 1 wherein there is a gap between said developer-conveying means and said moving surface of said image-forming means.

19. The developing apparatus of claim 1 wherein said developer-conveying member has a magnet member therein for attracting said developer.

20. A method of developing a latent image formed on an image-forming member, comprising the steps of forming developer into a developer layer, said developer layer being formed with a predetermined width transverse to a developer-conveying direction, conveying said developer layer to said image-forming member by a developer-conveyor member, said image-forming member and said developer-conveying member being so disposed as to form a developing area therebetween, smoothing the developer across the predetermined width with a first surface of the smoothing member at an upstream side in the conveying direction of said image-forming member in a vicinity of the developing area, while simultaneously contacting said image-forming member with a second surface of said smoothing member.

21. The developing method of claim 20, wherein said smoothing step so smoothes that the developer layer does not come in contact with the image forming member.

22. The developing method of claim 21, wherein there is further provided a step of applying an oscillating electric field onto the developing area.

* * * * *